US008002652B2

(12) United States Patent
Wong

(10) Patent No.: US 8,002,652 B2
(45) Date of Patent: Aug. 23, 2011

(54) SPORTING GAME OF SOKKER GOLPH™

(76) Inventor: Jacob Y. Wong, Goleta, CA (US)

( * ) Notice: Subject to any disclaimer, the term of this patent is extended or adjusted under 35 U.S.C. 154(b) by 19 days.

(21) Appl. No.: 12/291,906

(22) Filed: Nov. 14, 2008

(65) Prior Publication Data

US 2009/0170639 A1 Jul. 2, 2009

Related U.S. Application Data

(63) Continuation-in-part of application No. 12/214,904, filed on Jun. 20, 2008, now Pat. No. 7,780,555, and a continuation-in-part of application No. 11/478,955, filed on Jun. 29, 2006, now Pat. No. 7,520,830, and a continuation-in-part of application No. 11/478,956, filed on Jun. 29, 2006, now abandoned.

(60) Provisional application No. 60/707,695, filed on Aug. 11, 2005.

(51) Int. Cl.
*A63B 43/04* (2006.01)

(52) U.S. Cl. ..... 473/594; 473/595

(58) Field of Classification Search ..... 473/594, 473/570, 571, 595, 409; 434/251
See application file for complete search history.

(56) References Cited

U.S. PATENT DOCUMENTS 2,020,484 A * 11/1935 Turner ..... 473/570
2,301,506 A * 11/1942 Bean ..... 273/145 C
3,616,101 A * 10/1971 Satchell et al. ..... 473/354
4,266,773 A * 5/1981 Treadwell ..... 473/383
4,872,676 A * 10/1989 Townsend ..... 473/413
5,924,942 A * 7/1999 Gentile ..... 473/570
6,398,616 B1 * 6/2002 Motosko, III ..... 446/220
6,422,960 B1 * 7/2002 Touhey et al. ..... 473/593
6,572,499 B2 * 6/2003 Davies ..... 473/604
6,645,098 B1 * 11/2003 Quinn ..... 473/594
7,520,830 B2 * 4/2009 Wong ..... 473/594
2005/0049092 A1 * 3/2005 Lo ..... 473/594

OTHER PUBLICATIONS

"Different Curves: Baseball v beach ball", http://boards.straightdope.com/sdmb/archive/index.php/t-220857.html, retrieved Jun. 7, 2011, pp. 1-9.*

"On Airplane lift", http://boards.straightdope.com/sdmb/archive/index.php/t-324584.html, retrieved Jun. 7, 2011, p. 1.*

* cited by examiner

*Primary Examiner* — Steven Wong

(74) *Attorney, Agent, or Firm* — Roy L Anderson; Wagner, Anderson & Bright, P.C.

(57) ABSTRACT

A sporting game in which a game ball that behaves differently from a conventional soccer ball is kicked from a starting point toward an end point for the purpose of getting the game ball in the end point in as few as strikes as possible and, if this is not accomplished in one kick, then the game ball is kicked one or more additional times until it is in the end point. However, unlike the direction of travel for a conventional ball, the game ball's direction of travel is to the right when a counterclockwise spin is applied at a point of contact with the player's foot, to the left when a clockwise spin is applied at the point of contact, and straight when a top spin is applied at the point of contact.

4 Claims, 10 Drawing Sheets

SPORTING GAME OF SOKKER GOLPH™

CROSS-REFERENCE TO RELATED APPLICATIONS

The present application is a continuation-in-part application of U.S. patent application Ser. No. 12/214,904, filed Jun. 20, 2008, now U.S. Pat. No. 7,780,555, the disclosure of which is specifically incorporated herein by reference. The present application is also a continuation-in-part application of U.S. patent application Ser. Nos. 11/478,955, now U.S. Pat. No. 7,520,830 and 11/478,956, now abandoned, both of which were filed Jun. 29, 2006, which themselves were continuation-in-part applications of U.S. Provisional Patent Application Ser. No. 60/707,695, entitled "The Sporting Game of Sokker Golph™," filed Aug. 11, 2005, and the disclosures of all three of these prior applications are specifically incorporated herein by reference.

FIELD OF THE INVENTION

The present invention generally relates to the field of outdoor sporting games played in specially designed facilities such as a golf course or a soccer field.

BACKGROUND OF THE INVENTION

For over a century, the game of golf has always been considered as a game of the highest prestige and esteem. The reason is that the game of golf requires not only a player's developed skill but also one's mastery over one's mind when the game is played. In this respect golf is truly a unique game of its own unmatched by any others in the sporting field. Unfortunately for ordinary folks, golf has also been developed over the years primarily for people with means. It has been looked upon as only a rich man's game that requires not only expensive equipment to play (e.g. the golf club set and bag), but also fashionable attire and exquisite golf courses associated with country clubs accessible only to those lucky few that can afford such means. Although in recent years many more common people can afford to enjoy playing this game as equipment outlay, playing attire costs and green fees have all slowly come down from those of earlier years, golf still remains an expensive sporting game for people to play. It is of interest to note that golf today still has not been recognized and listed as a competitive sporting event in the Olympic Games. One of the reasons is that at present golf is still not considered as a game that is accessible for play by most common people.

The game of soccer has been considered for a long time by many as the most popular and beloved sporting game of the world. Only until relatively recently soccer was not a popular game in the United States, primarily because of the co-existence of the enormously popular game of American football. Over the past decade or so, the popularity of soccer in the United States has grown significantly because of the success of the American women's soccer teams in world competitions. Today soccer is just as popular, if not more so, as little league baseball for elementary school children, boys and girls alike. In the coming years it is difficult to not believe that soccer will rank equally in enthusiasm and support alongside with American football, baseball, ice hockey and basketball as the most popular seasonable sporting games in the United States.

As more and more people play golf in the United States when the overall playing cost for the game slowly declines over the years and the popularity of soccer has just about gone through the roof in about the same time span, particularly in the United States, an opportunity presents itself for introducing a game that combines the striking features of these two popular and beloved games into one that is more accessible to common people. Such a game, called "Sokker Golph™", will preserve, albeit in a different way, not only the fun and spirit of the golf game, but more importantly reduce the overall playing cost for the game to the point that almost anybody can afford playing it. A special ball which is similar to the regular soccer ball, but behaves totally differently when kicked or passed, is used to play the game of Sokker Golph™. The so-called skokker (short for "Skokker Ball™"), which is the subject of the current invention, exhibits an eccentric and rather uncontrollable motion in flight when kicked or on the ground when putted unless a concomitant spin is properly applied to it. In other words, the skokker allows properly trained players to control its motion on the ground and in the air. Once this is achieved, skilled soccer players can continue to use their ball handling skills in kicking and moving the skokker while playing the game of Sokker Golph™.

SUMMARY OF THE INVENTION

The present invention is generally directed to a sporting game in which a game ball is kicked from a starting point toward an end point for the purpose of reaching the end point in as few as kicks as possible and, if the game ball does not reach the end point when it is first kicked, then it is kicked with a player's foot one or more additional times until the game ball reaches the end point. Significantly, the direction of travel of the game ball will be to the right when a counter-clockwise spin is applied to it at a point of contact with the player's foot, to the left when a clockwise spin is applied and straight when a top spin is applied.

In a first, separate group of aspects of the present invention, the game ball has a hollow inner core partially filled with a fluid which is centered within a shell by a centering mechanism so the game ball will exhibit its unique direction of travel determined by swirling motion of the fluid. The core centering mechanism can be multiple struts or an inflatable support (such as a donut-shaped chamber having an inner radius substantially the same as an outer radius of the inflatable inner ball or at least three elastic spherical shells attached to the inflatable inner ball each of which has a substantially identical radius).

In a second, separate group of aspects of the present invention, sporting game is played on a course having N holes (where N is any positive integer greater than 0), and each of the holes has a unique starting point, a rough and a smooth with a unique buc located in it, the skokker ball having a diameter of approximately nine inches and each of the unique bucs has a diameter of approximately 18 inches. When the game is played by two or more players, the winner is the player who has the fewest strikes of the skokker ball.

Accordingly, it is a primary object of the present invention to provide a novel sporting game that combines elements of golf and soccer through the use of a new ball that exhibits eccentric rolling and flight characteristics not previously obtainable.

This and further objects and advantages will be apparent to those skilled in the art in connection with the drawings and the detailed description of the preferred embodiment set forth below.

DETAILED DESCRIPTION OF THE INVENTION

Figure 4:
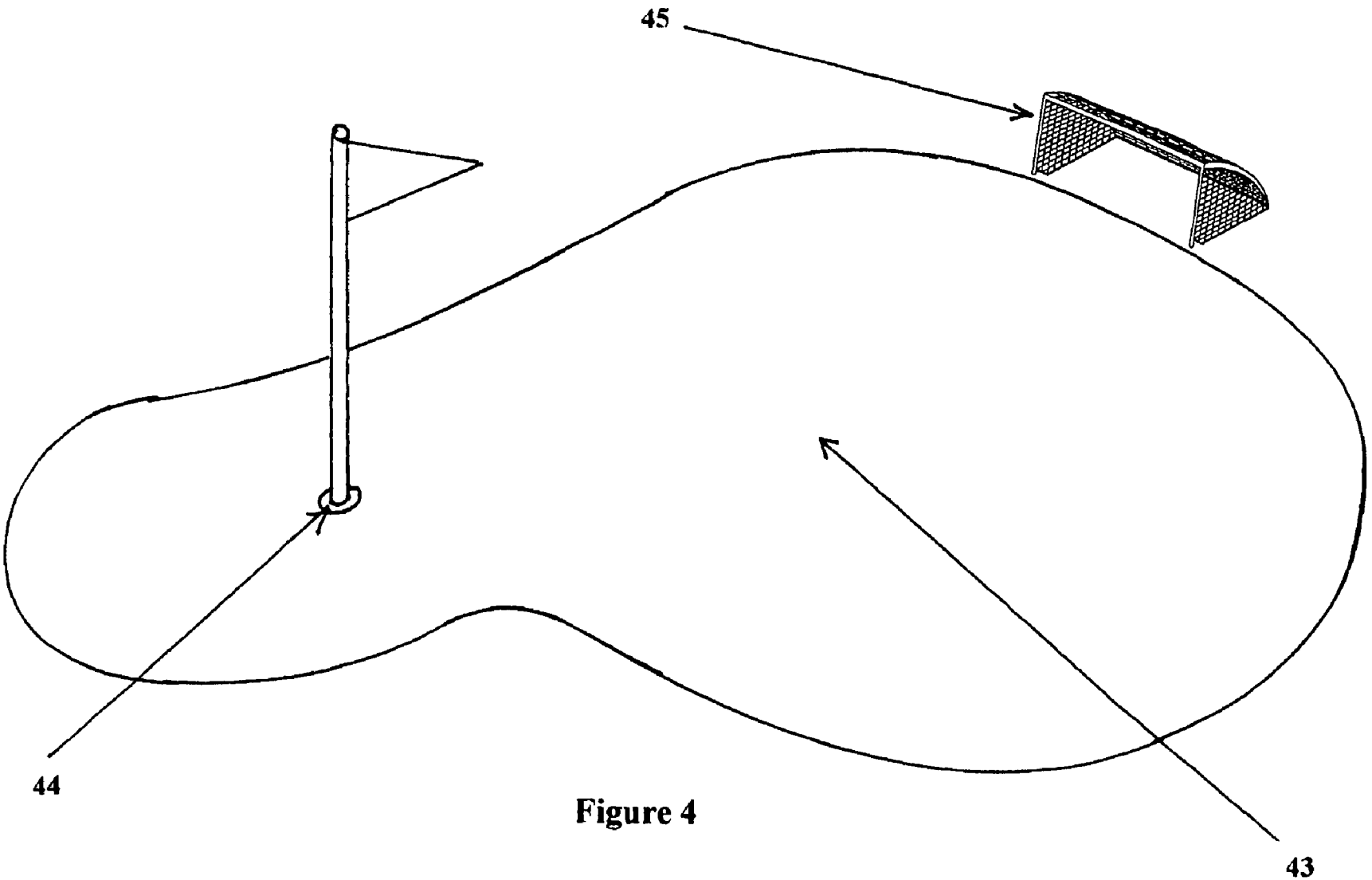
FIG. 4 depicts the location of a buc (a miniature soccer goal) on a regular green of a traditional golf course.

The present invention is directed to a new outdoor sporting game that combines the intrigue, skill and excitement features of the prestigious game of golf with the popular game of soccer. This new outdoor sporting game is called "Sokker Golph". The playing rules of this new game generally follow the framework of golf in that each player starts out with his or her own ball and attempts to place the ball into a designated end spot called a "buc" which can either be a hole (similar to golf) or a goal (similar to soccer—see 45 in FIG. 4). Like the playing of golf when a player using special clubs attempts to sink a ball into each of the 9 or 18 holes on a course with as few strokes as possible, the player playing Sokker Golph tries to achieve the same objective without the use of clubs but with a totally different ball (see FIGS. 1*a-c*). For playing a hole in Sokker Golph a player equipped with a special pair of shoes (optional) attempts to first kick the ball onto the "green" ("smooth" for Sokker Golph) and then sinks the ball into the hole (bucket or "buc"). Like golf, for playing a 9-hole or 18-hole game, whosoever uses the fewest strokes (drives or putts for golf and kicks and passes for Sokker Golph) to sink the ball into each of the 9 or 18 holes (bucs) wins the game.

Unlike the small golf ball used to play golf, a skokker game ball is considerably bigger (~9.0" in diameter) and is slightly bigger than the regular soccer ball which is ~8.5" in diameter. Apart from the size difference of the skokker game ball from either the golf or the soccer ball, the construct of the skokker game ball is totally different and the way in which this game ball plays, which is the critical difference between it and conventional balls, is totally different.

Figure 5:
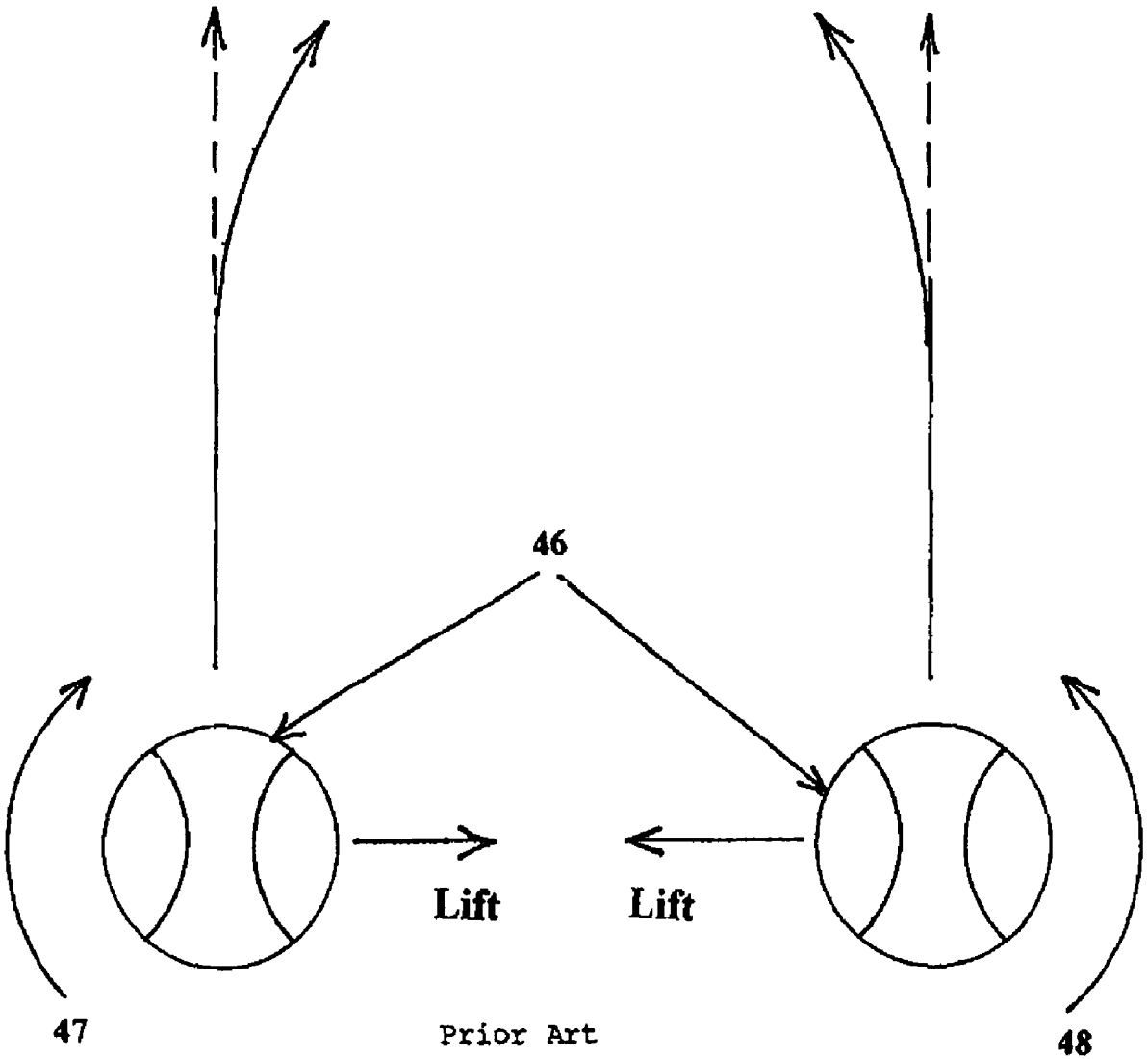
Prior Art Figure 5
FIG. 5 depicts the aerodynamic Magnus effect showing paths of a ball resulting from lifts when kicked with different spin directions.

Conventional balls have been around for quite some time, and it is well known that such balls can exhibit a curved path in flight. In fact, the flight paths of such balls were studied in the 1850s by Gustav Magnus and what is known as the Magnus effect is familiar to anyone who has watched a ball curve in flight. As noted in Halliday and Resnick, "Fundamentals of Physics", third Edition, John Wiley & Sons, 1988, page E6-8, the disclosure of which is specifically incorporated herein by reference, this effect plays a key role in such sports as baseball, tennis, golf, and soccer. By applying an appropriate spin, an athlete can make a ball curve in any chosen direction. For example, as illustrated in FIG. 5, if a soccer ball 46 is kicked so that the impact point is right of center—giving the ball a counterclockwise spin as seen from above—it will curve from right to left (48); if the kick is aimed left of center, the ball will curve to the right (47).

However, if one kicks a skokker game ball according to the present invention, it will not be controlled by the Magnus effect. Instead, it will exhibit a contrary direction of travel which I will call the skokker ball direction of travel in which the direction of travel of the skokker game ball will be to the right when a counterclockwise spin is applied to the skokker game ball at a point of contact with the player's foot, the direction of travel of the skokker game ball will be to the left when a clockwise spin is applied to the skokker game ball at the point of contact with the player's foot, and the direction of travel of the skokker game ball will be straight when a top spin is applied to skokker game ball at the point of contact with the player's foot. These unique and previously unexperienced and unexpected directions of travel are critical to the present invention.

In order for a skokker ball in accordance with the present invention to exhibit an eccentric and unpredictable motion unless a concomitant spin is appropriately applied to it, the motion of the ball must primarily be determined by movement of liquid within an interior volume of a central spherical chamber that is maintained substantially in the center of the ball during its motion. This requires the inner liquid to have sufficient weight, relative to the overall total weight of the ball, to influence the ball's motion. It also requires that interior volume to be sufficiently large, relative to the volume displaced by the inner liquid, so that the liquid has space to swirl within the interior volume to thereby affect movement of the ball. For example, it has been found that if a central spherical chamber has half the diameter of the ball, and water is used as liquid, the ball will function properly when roughly one-quarter of interior volume is filled with the water when the weight of such water is approximately one-third to one-half of the total weight of the ball.

Because of the special design of a skokker game ball according to the present invention, it behaves very differently from a regular inflatable ball upon either being kicked or struck (putted). This difference in behavior is attributed to the unpredictable movement of liquid fluid that partially occupies the central spherical chamber upon being kicked or struck. Thus, unlike kicking a regular inflated ball whose direction of travel depends primarily upon the kicker's aim and optional spin, the travel direction of the currently invented ball is simply unpredictable unless it is being kicked or struck in a special manner as explained below.

Figure 2:
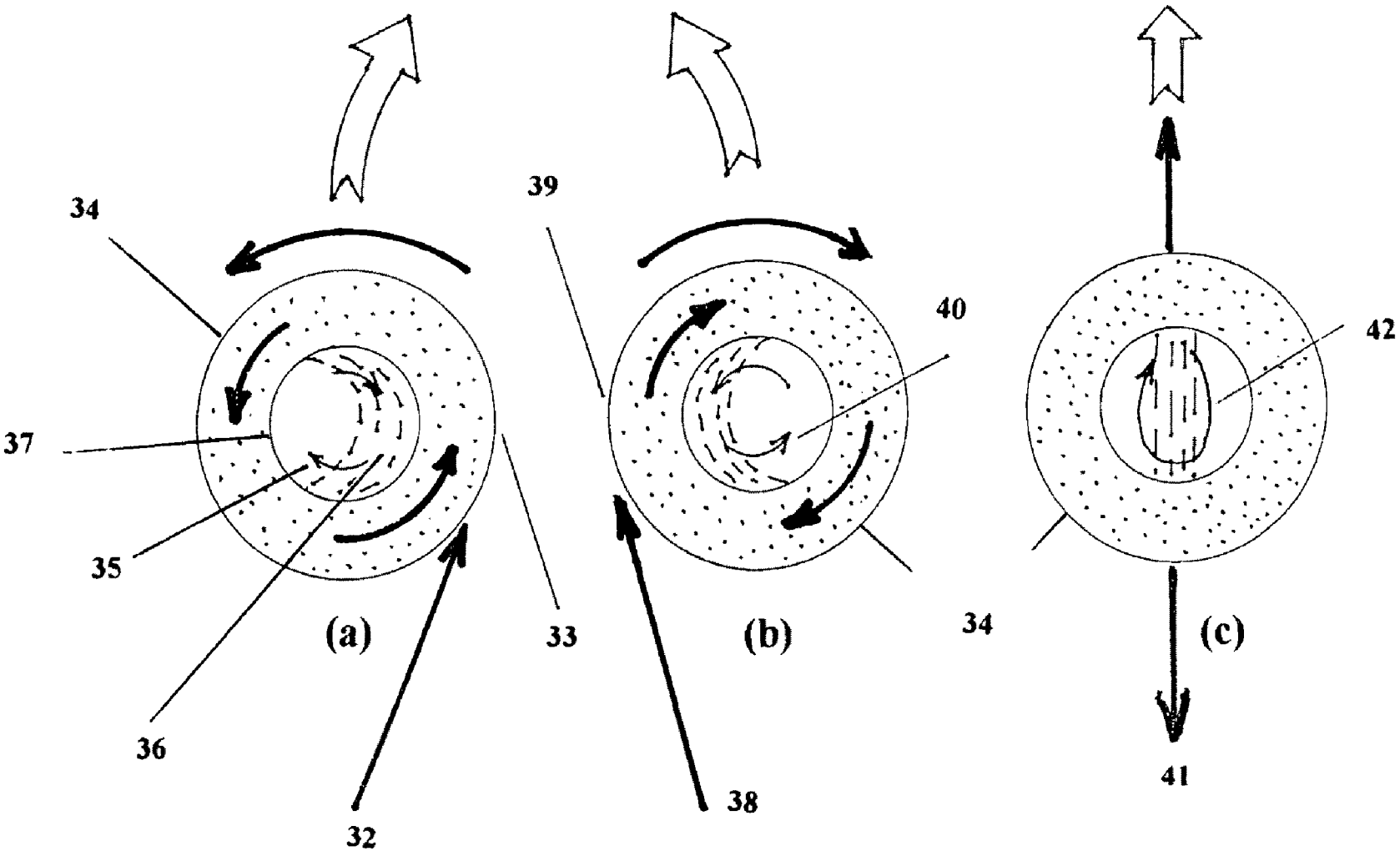
FIG. 2 depicts the directional motion of a preferred embodiment of an inflatable ball with predictable movements when a spin is concomitantly applied to a) right side of the ball; b) the left side of the ball and c) the top surface of the ball with the kicking.

To determine the travel direction of a skokker ball upon either being kicked or struck (putted), a spin must be imparted onto the ball in order to control the motion of the partially filled liquid in the central spherical chamber of the ball. In other words, the spin imparted onto the ball will cause liquid inside central chamber to swirl substantially in a well-defined manner such as a clockwise, counterclockwise, top to bottom or bottom to top spinning direction as depicted in FIG. 2. It is this swirling motion of the liquid at the central chamber of the ball that will determine the motion of the ball and its subsequent direction of travel. In other words unless the ball is kicked or struck in a deliberate fashion, the ball will have a mind of its own upon being casually kicked or struck and will travel in a totally uncontrollable and unpredictable manner.

As shown in FIG. 2(*a*) when a counterclockwise spin 32 is applied to the right side 33 of skokker ball 34 while it is being kicked or struck, an equivalent clockwise spinning effect 35 is imparted to liquid 36 inside central chamber 37 thus causing the directional motion of ball 34 to the right. When a clockwise spin 38 is applied to the left side 39 of ball 34 while it is being kicked as shown in FIG. 2(*b*), an equivalent counter-clockwise spinning effect 40 is imparted to liquid 36 inside central chamber 37 thus causing the directional motion of ball 34 to the left. In FIG. 2(*c*) when a top spin 41 is imparted to the ball while it is kicked, the effective spinning on liquid 36 inside central chamber 37 remains in the vertical plane 42 and the ball will subsequently go in a straight direction without swirling left or right. The examples given above are for pure spin actions only. In actuality this seldom happens and the spin imparted to the ball by the kicker is some kind of a mixture of spin actions illustrated in FIG. 2. Nevertheless, it is possible to control the directional motion of ball 34 in flight or on the ground by applying a deliberate and appropriate spin to it while kicking or striking (putting) same. In one extreme situation, ball 34 could be made to behave like a boomerang to come back right at the kicker after it is appropriately kicked. However, it would take a lot of practice and trial before one can achieve such a feat.

Thus, unlike many balls advanced earlier that produce for fun erratic and uncontrollable movements, or making random clattering sounds, or can be lighted up in the dark, the currently invented skokker ball is special in that its motion in flight or on the ground is totally controllable by the player. However, a player must learn, through a lot of training and practice, to control its directional motion, either in flight or on the ground. Such is desirable if a skokker-ball is to be used for the game of Sokker Golph. This is because a sporting game has hardly any meaning in playing if everything about playing it is pretty much left to luck or accidental happenings. The game of golf will never be the same if there is no control of driving or putting the ball through a lot of hard work, practice and self-discipline. Similarly, even for the game of soccer, it would not be the same game if the ball could not be skillfully controlled by the players, again through a lot of practice and hard work, but is left only to random and unpredictable motions.

Figure 1A:
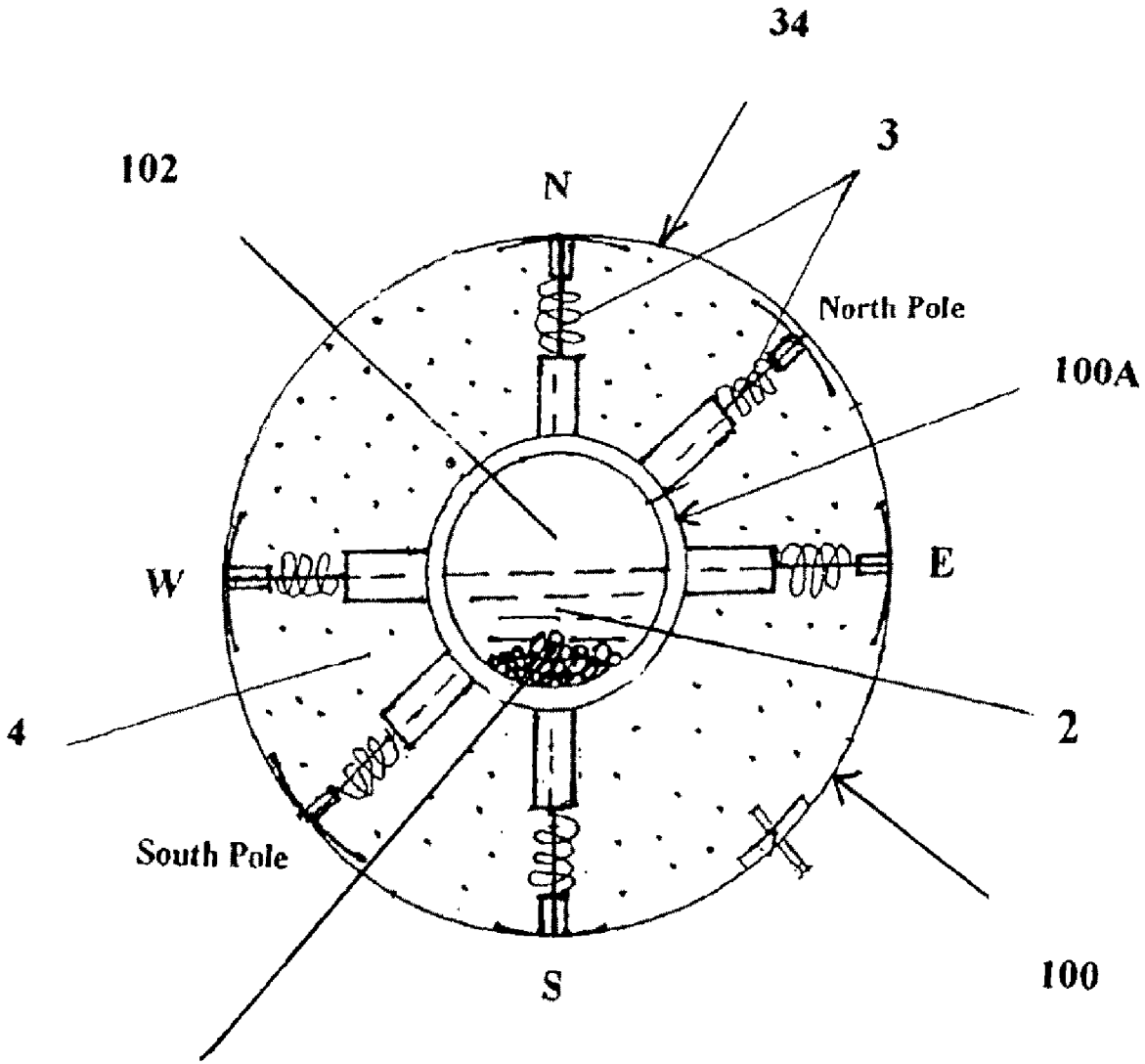
FIG. 1*a* depicts the schematic layout for the design of a preferred embodiment of an inflatable ball with predictable movements showing its detail construct.

A first construct for a skokker ball 34 is illustrated in FIG. 1*a* which has six elastic anchoring struts 3. When the space 4 between the core 1 and the outer surface of the skokker ball is inflated with air, the skokker ball becomes bouncy like a soccer ball. Since the size of the skokker ball is ~9.0" in diameter, the size of the buc on the smooth (~15" in diameter) is also considerably larger than the size of the hole on the putting green for golf.

The hollow spherical shell or inner core 1 is supported at the center of a skokker game ball 34 by six protruding struts 3 with four of the six struts located at the equatorial directions of East, South, West and North and the other two pointing at the North and South Pole position respectively as portrayed in FIG. 1*a*. This arrangement allows the points of contact of each of the six struts with inner core 1 and an inner surface 100A of ball shell 100 to be uniquely defined by two planes that perpendicularly intersect each other such that each of the two planes will contain four of the six attachment points with inner core 1 and four of the six connection points with the ball's inner surface 100A. Each of the six protruding struts 3 presses against an inner surface 100A of an outer ball shell 100 of skokker ball 34 though a stiff spring and an elastic flap. It is through the specially designed springing action of struts 3 exerting equal and constant pressure at inner core 1 that the latter is kept always at the center of skokker ball 34, even when the latter is being kicked or struck. Meanwhile the space or air pocket 4 between inner core 1 and inside surface 100A of ball shell 100 is filled with compressed air whose pressure is controlled by letting air in or out of a built-in inflation valve. When skokker ball 34 is properly inflated, its pressure is ~6 psi and the diameter of skokker ball 34 is approximately 9.0".

In order for inner core 1 with its fluid 2 in motion to control the resultant motion of skokker ball 34, either on the ground or in flight, the weight distribution between inner core 1 and its fluid 2 and the rest of skokker ball 34 must be designed to have at least a 1:1 ratio. Another factor that must be taken into consideration is the overall weight of skokker ball 34 which ideally should not be heavier than about one pound, or the weight of a regular soccer ball. Because of this consideration, the size of inner core 1 is optimally set, in an especially preferred embodiment used for Sokker Golph™, at ~3.0" in diameter.

One way to increase the weight distribution is to increase the volume of fluid 2 that inner core 1 contains. This is because the density of fluid 2 is much greater than that of air and supporting struts 3 of skokker ball 34. However, as more and more fluid is put inside the sealed spherical cavity 102 of inner core 1 so that it exceeds ~50% of the internal volume of cavity 102, the motion of fluid 2 inside cavity 102 will also be constrained, thereby effectively decreasing the influence of fluid 2 on the resultant motion of skokker ball 34. The amount of fluid 2 contained inside cavity 102 can be a small fraction of the internal volume of cavity 102 up to ~50% of it. Since the density of air is ~0.0012 gm/cc and the density of fluid 2 (oil or water) is ~1.0 gm/cc, for a 9.0" diameter skokker ball 34 with a 3.0" diameter inner core 1, when cavity 102 is filled with ~50% of its volume with fluid 2, the weight ratio of fluid 2 to ball shell 100 plus struts 3 (plus compressed air in air pocket 4) can be adjusted to be close to the desired 1:1 ratio. Such a structure for skokker ball 34 with fluid 2 in cavity 102 of inner core 1 dominating its motion is critical to the current invention.

A weight ratio of greater than 1:1 can be achieved by replacing some of the volume of fluid 2 in cavity 102 of inner core 1 with tiny metallic spheres 121A of the order of 1 mm diameter made of a metal, such as, for example, steel, brass or copper. (Although such spheres are solid and thus not within the normal definition of a "fluid," when such spheres are added to fluid 2 they are deemed to be part of fluid 2 for purposes of the description of the present invention because they increase the density and weight of fluid 2 relative to gas that occupies the remaining volume of cavity 102 and they still allow fluid 2 to maintain its same functional characteristics with respect to the motion of skokker ball 34 and its direction of travel of travel when a force is applied to it to move it or change its direction of travel, as will be described later herein.) Thus, for example, if one were to use steel spheres with a density ~7.8 gm/cc to displace 25% of the fluid volume while still maintaining cavity 102 half-filled with fluid by volume and half filled with air by volume, the weight ratio of fluid 2 (including steel spheres) to that of ball shell 100 and struts 3 (plus compressed air in air pocket 4) could be significantly increased to 3:1. There is no doubt that causing fluid 2 to have such a high weight ratio will have a significant effect on the motion of skokker ball 34; however, the overall weight of skokker ball 34 might in this case be too excessive. The current invention allows a preselected desired weight ratio to be designed into skokker ball 34 according to a designer's particular wishes, which also adds the option of changing the characteristics of skokker ball 34 for differing situations and applications, or even for games other than Skokker Golph™, as well as for creating skokker balls of different sizes for differing applications. (Thus, for example, one might design a skokker ball 34 for use instead of a volleyball or a kickball, and one could also design other games, or modify existing games, to take advantage of the unique characteristics obtainable by use of a skokker ball, or a skokker ball of a different size or diameter).

Figure 1B:
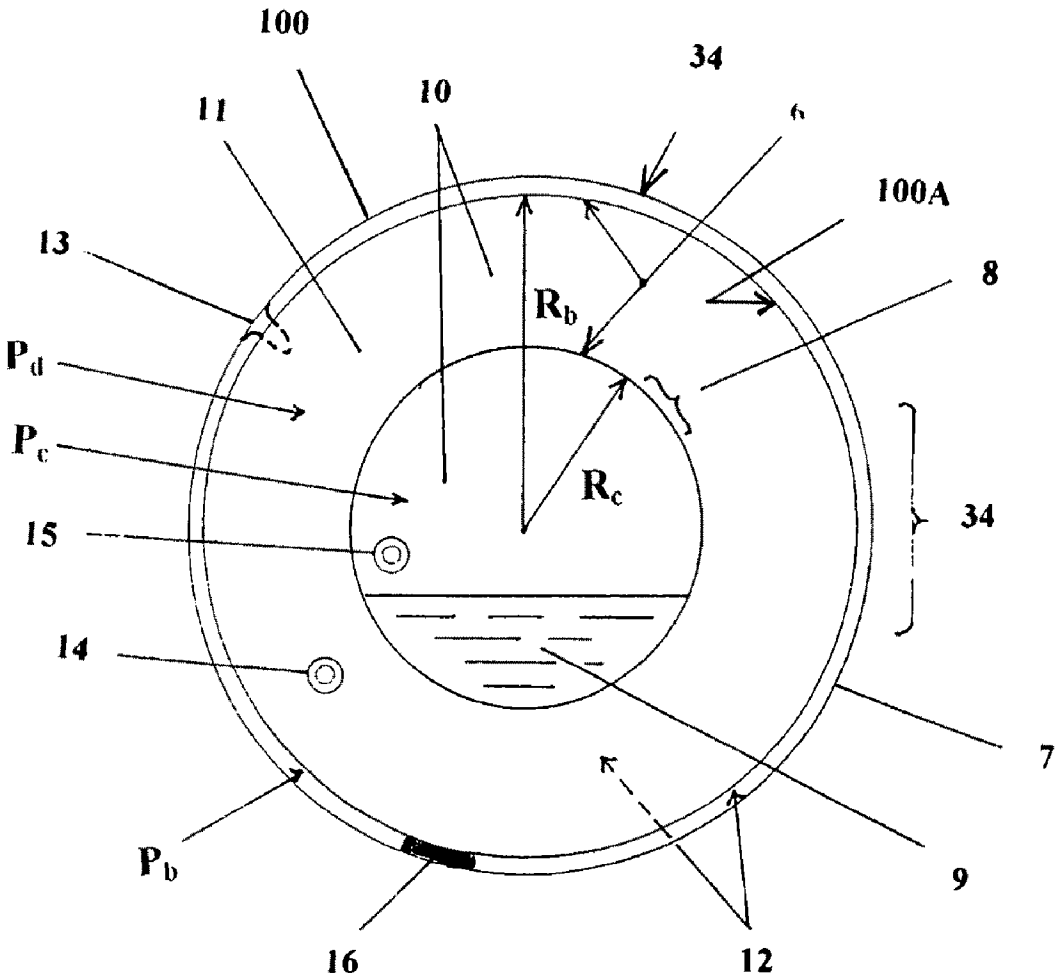
FIG. 1*b* depicts the schematic layout for the design of a second preferred embodiment of an inflatable ball with predictable movements showing its detail construct.

A second construct for a skokker ball is illustrated in FIG. 1*b* which depicts the schematic layout for the design of a preferred embodiment of a skokker ball 34 showing the construct of an elastic Planet Saturn (PS) shaped chamber assembly 6 completely enclosed by an air-tight flexible outer wall or skin 7. The PS shaped chamber assembly 6 comprises a centrally located elastic spherical chamber 8 having radius Rc and partially filled with a liquid fluid 9 such as water and appropriately pressurized with air 10 to a pressure Pc. Permanently attached to the central chamber 8 around its equator is an elastic donut-shaped chamber 6 having an inner radius Rc, the same as that for the central chamber 8, and an outer radius of Rb equal to the inner radius of the outer wall of the ball 34. The donut-shaped chamber 6 is also appropriately filled with air to pressure Pd. The cross-sectional area of the donut-shaped chamber 6, which is equal to $\pi[(Rb-Rc)]/2)2$ is considerably smaller than the cross-sectional area of ball 34. Hence there is ample space left inside ball 34 not occupied by the PS shaped chamber assembly 6 even if the latter is appropriately inflated.

The air pressure for the remaining inner space 12 of ball 34, not occupied by the elastic PS shaped chamber assembly 6 is denoted by Pb, which has a slightly different value from those of Pc or Pd. Also shown in FIG. 1*b* are three stem air valves 13, 14 and 15 for letting air into or out of ball 34, the donut-shaped chamber 6 and the central spherical chamber 8, respectively. Air valves 14 and 15 are purposely located to be close to each other. A re-sealable slit opening 16 typically less than 2.0" long and 0.025" wide allows the insertion of the entire deflated PS shaped chamber assembly inside ball 34 during production is located on the air-tight flexible outer skin as depicted in FIG. 1*b*.

As shown in FIG. 1*b*, skokker ball 34 comprises an air-tight flexible outer skin 100 such as thin sheet plastic, rubber and the like, which, when properly inflated and fully expanded, defines an interior volume wherein a properly inflated PS shaped chamber assembly 6 fits snugly. Once inside the interior volume of skokker ball 34, the pressures Pc and Pd of the central spherical chamber 8 and the donut-shaped chamber 6 respectively are appropriately adjusted so that the surfaces of the latter are snugly pushing against inside 100A of the ball's outer skin 100. Such a snug fit will guarantee that the central spherical chamber 8 will be maintained substantially always at the center of skokker ball 34. This is the case as long as Pb, the pressure of the ball's inner space, is always kept slightly below that of Pd and Pc. However, the values of Pd and Pc must be properly adjusted during production so that Pb can always be kept high enough to ensure the overall shape of ball 34 to be spherical instead of slightly oblong if the pressure Pb is too low with respect to pressures Pd and Pc.

In designing a skokker ball 34 according to the present invention, outer skin 100 will typically be heavier than material used for the elastic PS shaped chamber. There are two reasons for this. First, outer skin 100 requires a certain degree of toughness, especially if the ball is to be kicked, whereas the elastic PS shaped chamber requires no such toughness. Second, because it is desirable to concentrate the overall weight of the ball in the liquid fluid in central spherical chamber 4, any weight associated with the elastic PS shaped chamber should be minimized.

As alluded to earlier, one primary objective of the presently invented ball 1 is to render its production completely viable, straightforward and low cost. With reference to FIG. 1*b*, conventional injection molding techniques of producing inflatable balls of all types with the use of airtight, elastic and flexible outer skins such as sheet plastic, rubber and the like can be utilized to fabricate the presently invented ball 1*b*. As an example, the steps to manufacture an eight-inch diameter currently invented ball 1 are described in my U.S. Ser. No. 12/214,904, filed Jun. 20, 2008, and will not therefore be repeated here.

As an example for fabricating an eight in. (8") diameter currently invented ball 34, the radius Rc for the central spherical chamber 8 and the radius of the cross-section of the donut-shaped chamber 6, namely (Rb−Rc)/2, are 2.0" and 1.0", respectively. The thickness of the elastic PS shaped chamber assembly 6 should be roughly half the thickness of the outer skin 100 which is ~0.025". Assuming the density of the sheet plastic or rubber used is ~5.0 gm/cc, the overall weight of the 8.0" diameter ball 34 excluding the liquid fluid in the central spherical chamber 8 is around 4.5 oz. The ideal amount of fluid in the central spherical chamber for producing the optimum swirling effects is ~86 cc of water or ~3.0 oz. Thus the overall weight of the currently invented ball 34 is around 7.5 oz which is ideal for a general purpose inflatable recreational ball. Needless to say, the dimensions for the various constituents of the currently invented 8" diameter ball 34 as an example will not be the same for different balls to be used under different circumstances.

As alluded to above, both the outer skin 100 and the elastic PS shaped chamber assembly 6 can be readily manufactured using conventional inflatable ball molding techniques. The assembly of these two molded parts into the final ball 34 is rather straightforward and is described in my U.S. Ser. No. 12/214,904, filed Jun. 20, 2008, and will not therefore be repeated here.

Figure 1C:
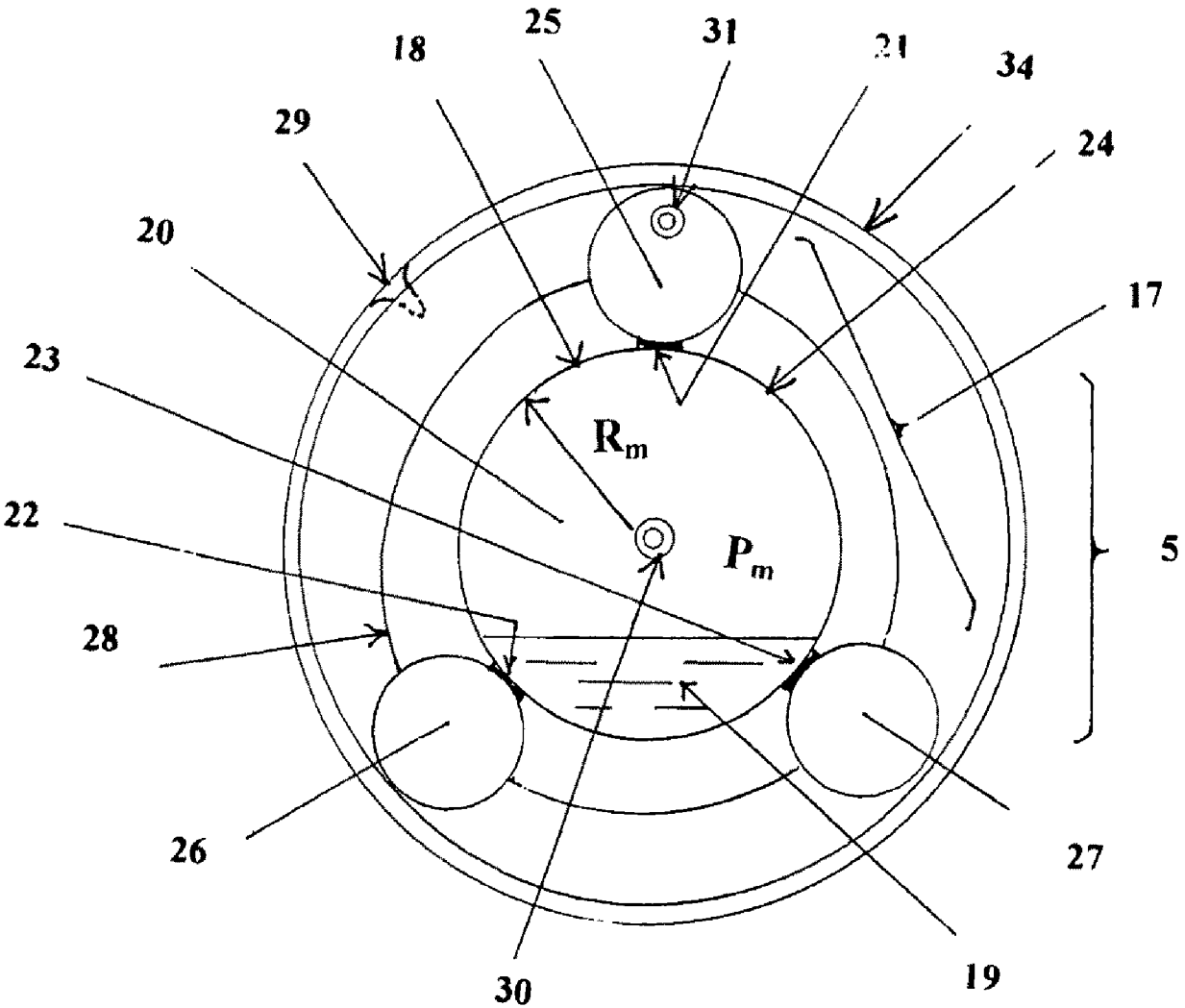
FIG. 1*c* depicts the schematic layout for the design of a third preferred embodiment of an inflatable ball with predictable movements showing its detail construct.

A third construct for a skokker ball is illustrated in FIG. 1*c*. As shown in FIG. 1*c*, The elastic multi-chamber assembly 17 comprises a centrally located elastic spherical shell 18 having radius Rm and partially filled with a fluid 19 such as water and appropriately pressured with air 20 to a pressure Pm. Permanently attached to the central spherical shell 18 at locations 21, 22 and 23 respectively along its equator 24 are three independent elastic spherical shells 25, 26 and 27 interconnected via tubes 28 and all having the same small radius Rs. The three elastic shells 25, 26 and 27 whose centers lie on the equatorial plane of the central elastic spherical shell 18 defined by its equator 28 are 120° apart from one another with respect to the latter's center. Also shown in FIG. 1*c* are three stem air valves 29, 30 and 31 for letting air respectively into ball 34, the central elastic spherical shell 18 and the common air space shared among the three adjoined elastic spherical shells 25, 26 and 27.

The remaining construction steps for the embodiment shown in FIG. 1*c* are identical to those described earlier for the embodiment shown in FIG. 1*b*.

When playing golf or soccer, the player can wear a special pair of shoes. In the former case, in addition to adding comfort to the player while walking, the shoes also protect the grass on the fairway and especially that on the putting green. In the latter case, the shoes provide traction and agility for the players. As for special shoes used to play Sokker Golph, their primary function in addition to providing walking comfort to the player is to facilitate the application of a desired spin onto the SG ball when the latter is being kicked or passed. Even with the special shoes, players who wish to play well in Sokker Golph have to develop the appropriate skill for applying the right spin to the SG ball. Thus it is by no means a walk in the park for players who wish to excel playing Sokker Golph. Like the playing of golf or soccer, a player must devote a lot of training time and efforts to this game before he can master it well.

Figure 3A:
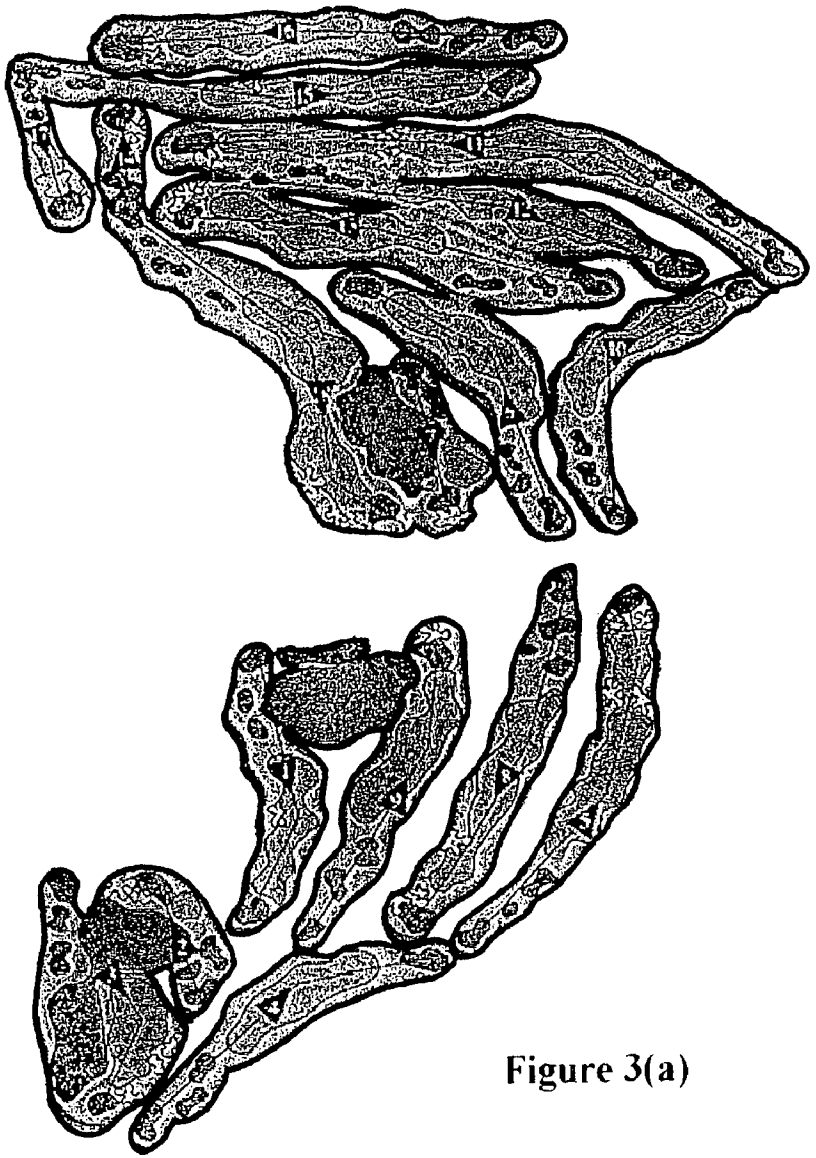
FIG. 3 depicts the different design for a Sokker Golph (SG) course: (a) a design following a 9 or 18 hole golf course layout; (b) a design utilizing a standard soccer playing field; (c) a design utilizing an American football playing field and (d) any plausible design with sufficient space for laying out an SG course with at least one buc or miniature soccer goal.
Figure 3:
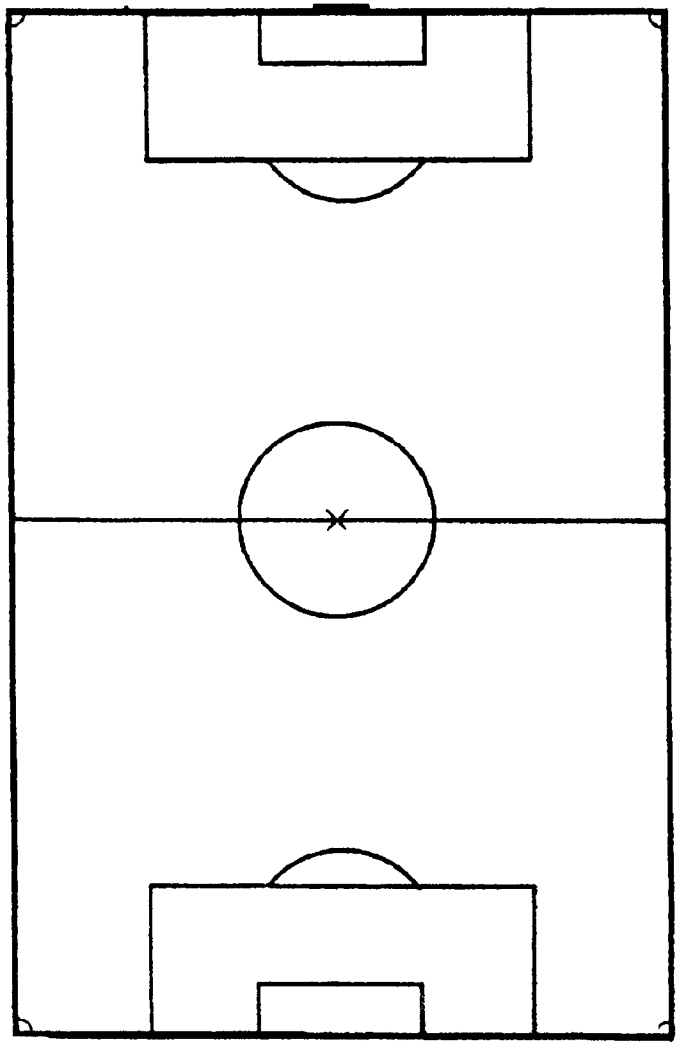
Figure 3C:
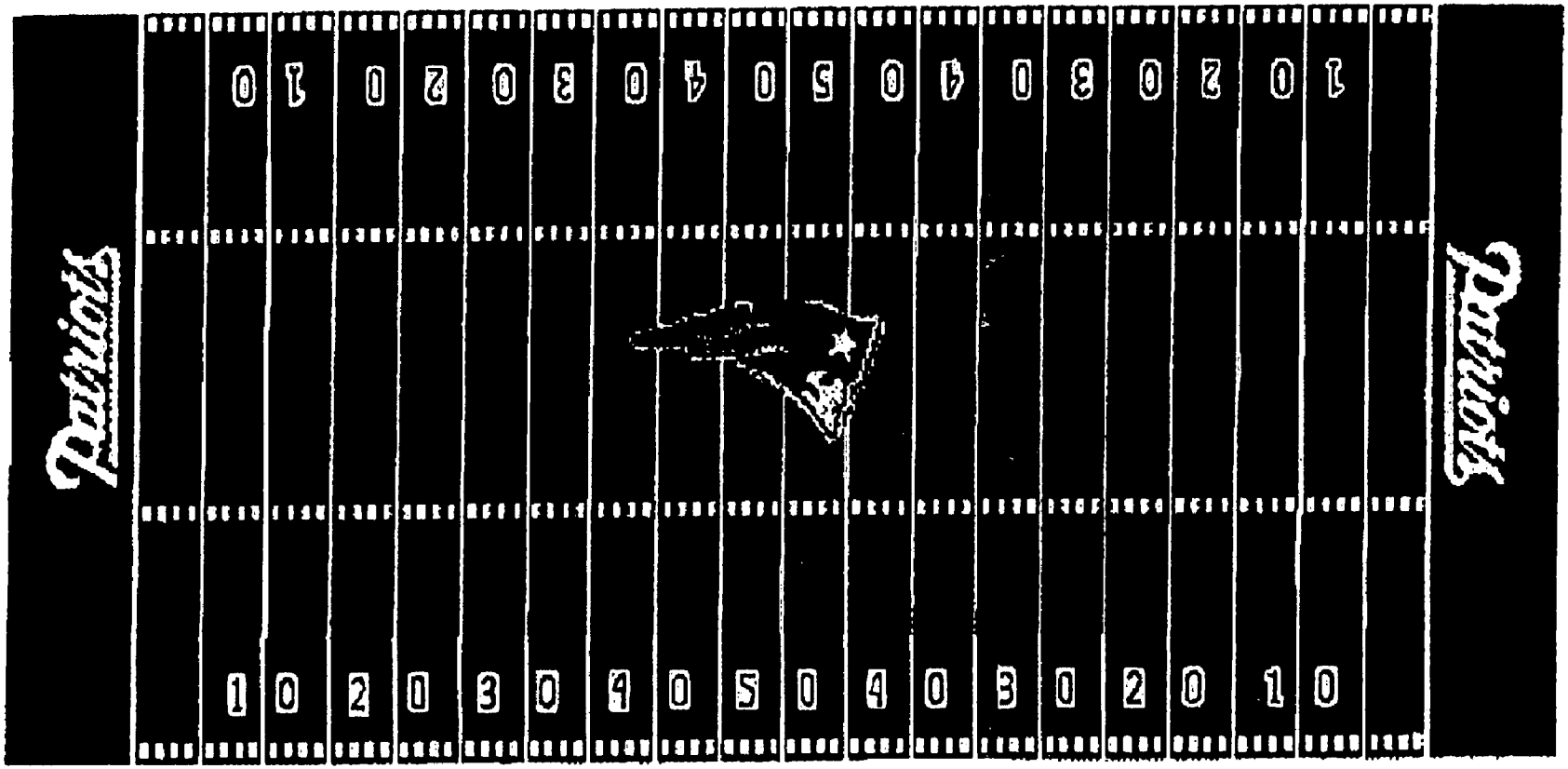
Figure 3D:
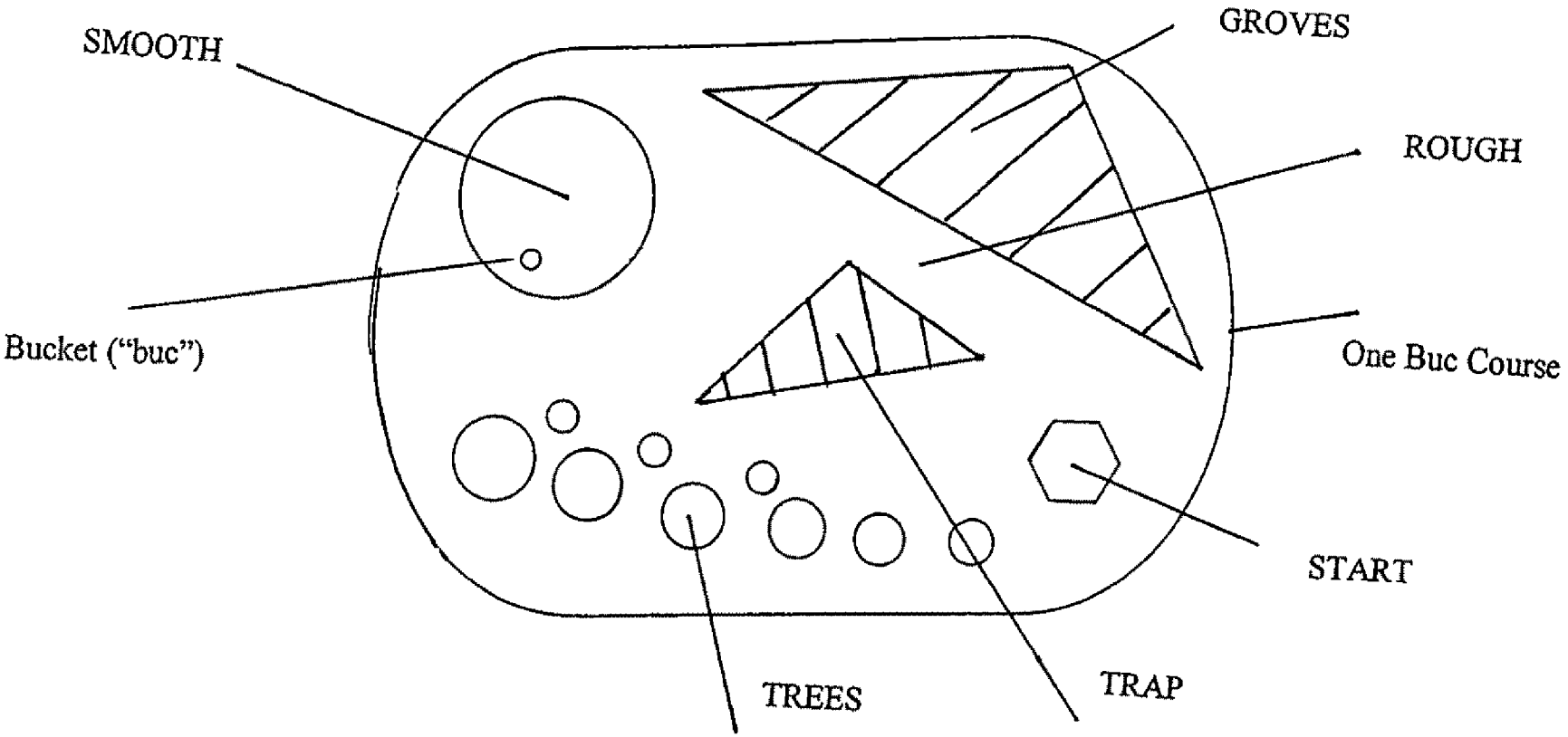

FIG. 3 depicts four different possible designs for a Sokker Golph (SG) course. As far as the playing or SG course for the playing of Sokker Golph is concerned, any golf course such as shown in FIG. 3(*a*) maintained in reasonable shape will do fine. The only change required to turn a golf course into a SG course is the replacement of the hole 44 on the putting green 43 for golf with a bucket or "buc" 45 for Sokker Golph (see FIG. 4). In order not to rough up the putting green and the delicate replacement of the hole, the buc can be located in a completely different place as long as it is located somewhere on the putting green or SG smooth for Sokker Golph. The diameter of the buc should be approximately twice that of the skokker or ~18 inches if the buc is a hole or be a movable goal as shown in FIG. 5 having an approximate dimension of 24 inches wide, 18 inches tall and 18 inches deep.

The game of Sokker Golph can also be conveniently played on any soccer field or American football field as depicted in FIGS. 3(*b*) and 3(*c*), respectively. Since the design of the SK course need not adhere rigidly to that for the golf course, any big enough span of space like a soccer or American football field can be divided into a 6 or 9-buc course. Such a division and the appropriate placement for the bucs can be left entirely to one's liking or imagination. Finally, for just the practice of the game, a SG course can have only one or more bucs. Since the bulk of the skill development for this game lies in the kicking and passing of the SG ball with the application of the correct spin, any street corner can be turned into a one-buc SG course as long as a bucket or buc is appropriately located (see FIG. 3(*d*)).

The playing rules of Sokker Golph generally follow the framework for the game of golf, but the game format is not as rigid as golf. Thus, the game of golf pretty much dictates that one has to play a 9-hole or 18-hole game, whereas one can play an N-buc game for the Sokker Golph where N can be any positive integer 1 through 18 or even larger. Also, unlike the golf course for playing golf, the SG course for playing Sokker Golph can be arbitrarily designed in size and shape to accommodate any number of bucs as long as there is for each buc a starting point for launching the SK ball game and a well-defined "rough" (equivalent to the fairway for golf) associated with that buc including a "smooth" (equivalent to the putting green for golf with a bucket or buc (equivalent to the hole) located on it. Otherwise, like the game of golf, players can be grouped together to play either as a twosome or foursome. The playing rules for Sokker Golph then follow closely to those for playing golf when each particular buc is associated with a number of kicks or passes for sinking the SG ball into it. Thus a par 4 hole in golf shall be called a par 4 buc in Sokker Golph. Similarly, a hole in one, an eagle, a birdie, a par and a bogey are called respectively a buc in one, an eagle, a birdie, a par and a bogey for Sokker Golph.

Let us now describe the game of Sokker Golph in more details as follows:

Name of Sporting Game: Sokker Golph aka SG.

Number of Players: Unlimited subject only to the confine of the length of the available playing time and the facility (SG course) size.

Teaming: Players are grouped into twosomes or foursomes for playing each Sokker Golph game.

Score Keeping: For a twosome grouping, the two players are responsible for keeping the scores of each other after each buc of play. For a foursome grouping, each of the two twosome pairs is responsible for keeping the scores of each other after each buc of play as described earlier.

Length of Game: Can be an N-buc game where N is any positive integer. Thus it can be a 6-buc, 9-buc game etc.

Place of Play: Called a SG course which can be designed to play any N-buc game. The shape and size of the SG course will be determined accordingly.

Game Equipment:

1. SG Ball. A special ball, approximately 9.0" in diameter for a regular ball (smaller for junior sizes), in which the direction of travel of the ball will be to the right when a counterclockwise spin is applied to the ball at the point of contact, the direction of travel of the ball will be to the left when a clockwise spin is applied to the ball at the point of contact, and the direction of travel of the ball will be straight when a top spin is applied to ball at the point of contact.

2. Special Shoes. To play Sokker Golph, one may want to wear a pair of special shoes in order to facilitate the application of an appropriate spin to the SK ball during kicking or passing of the latter during play. For a right-handed person, the right shoe is for kicking only while the left foot is devoted to only passing. The reverse is true for the left-handed player. A Special rule for playing the Sokker Golph game is that a different foot has to be used in kicking or passing of the SK ball. Thus, if one uses one's right foot to kick the SG ball onto the "smooth", then one must only use one's left foot to pass the ball into the buc on the "smooth and vice versa. No kicking is allowed once the SK ball lands on the smooth. Accordingly, there might be a considerable difference in construction between the right shoe and the left shoe.

3. The "Bucket." A plastic bucket (the "buc") having a diameter of fifteen (15) inches and eight (8) inches deep for marking the buc on the "smooth". Each smooth for each buc of the SG course must be installed with a bucket to define the location of the buc.

The Actual Game Playing:

1. The prerequisite. With a particular SG course chosen and the number of bucs to play for the game, the players, optionally wearing their respective special shoes, and carrying their own SG balls, are grouped together as twosomes or foursome with their order pf play determined ahead of time.

2. The Play. Starting out with the first buc in the SK course, the first player from the first twosome will kick off his or her own identifiable SK ball followed by the player's partner in the twosome. If the grouping is a foursome arrangement, then the next twosome will follow the first twosome to kick off.

3. The Right Order to Play. Starting out with the first buc, the first twosome to play always has the right to complete the playing of a particular buc before the follow-on twosome. Like in golf, the second twosome will not start play or kick down the "rough" until the first twosome reaches the corresponding "smooth."

4. The End Play. The play described above will continue until the first twosome finish all the bucs supposed to be played followed by all the other players doing the same.

5. The Score Tally. Since the players of each twosome take care of each other's scores as the game progresses, when all the players finish the last buc, they all turn in their score cards to a designated referee and it is the referee who will tally all the scores for the players and determine the game winner, runner-up, etc.

Thus, there has been described above the salient features of the sporting game "Sokker Golph". While the invention has been described herein with reference to certain preferred embodiments, those embodiments have been presented by way of example only, and not to limit the scope of the invention. Additional embodiments thereof will be obvious to those skilled in the art having the benefit of this detailed description. Further modifications are also possible in alternative embodiments without departing from the inventive concept. For example, the motion of the skokker and its direction of travel away from a point of contact might be altered by using a core cavity of a shape different than a sphere.

Accordingly, it will be apparent to those skilled in the art that still further changes and modifications in the actual concepts described herein can readily be made without departing from the spirit and scope of the disclosed inventions as defined by the following claims.

What is claimed is:

1. A method of playing a game with a game ball, comprising the step of:

causing the game ball to exhibit a skokker direction of travel by applying a spin to the game ball at a point of contact;

wherein the skokker direction of travel will be to the right when a counterclockwise spin is applied to the skokker game ball at the point of contact, to the left when a clockwise spin is applied to the skokker game ball at the point of contact, and straight when a top spin is applied to the skokker game ball at the point of contact;

and wherein the game ball is comprised of a liquid movable within an interior spherical chamber that is held within an inner cavity of an outer ball shell such that said spherical chamber is maintained substantially in the center of the game ball during motion of the game ball and said motion is primarily determined by movement of the liquid within the interior spherical chamber such that the game ball can exhibit the skokker direction of travel.

2. The method of claim 1, wherein the spin is applied to the ball at the point of contact by a players foot.

3. The method of claim 1, wherein the spin is applied to the ball at the point of contact by a player's hand.

4. The method of claim 1, wherein the spin is applied to the ball at the point of contact by an inanimate object.

* * * * *